US010309029B2

(12) United States Patent
Duffy et al.

(10) Patent No.: US 10,309,029 B2
(45) Date of Patent: Jun. 4, 2019

(54) METHOD FOR FORMING A MULTI-LAYER ANODIC COATING

(71) Applicant: Dublin Institute of Technology, Dublin (IE)

(72) Inventors: Brendan Duffy, Kildare (IE); Michael Whelan, Kildare (IE)

(73) Assignee: Technological University Dublin, Dublin (IE)

( * ) Notice: Subject to any disclaimer, the term of this patent is extended or adjusted under 35 U.S.C. 154(b) by 289 days.

(21) Appl. No.: 15/105,785

(22) PCT Filed: Dec. 19, 2014

(86) PCT No.: PCT/EP2014/078700
§ 371 (c)(1),
(2) Date: Jun. 17, 2016

(87) PCT Pub. No.: WO2015/091932
PCT Pub. Date: Jun. 25, 2015

(65) Prior Publication Data

US 2016/0312374 A1 Oct. 27, 2016

(30) Foreign Application Priority Data

Dec. 20, 2013 (GB) ..... 1322745.9

(51) Int. Cl.
*C25D 5/00* (2006.01)
*C25D 11/00* (2006.01)
(Continued)

(52) U.S. Cl.
CPC ..... *C25D 11/12* (2013.01); *C25D 11/024* (2013.01); *C25D 11/04* (2013.01); *C25D 11/06* (2013.01);
(Continued)

(58) Field of Classification Search
CPC ..... C25D 11/02; C25D 11/08; C25D 11/12; C25D 11/34; C25D 11/246; C25D 5/00; C25D 11/00
(Continued)

(56) References Cited

U.S. PATENT DOCUMENTS 3,962,049 A 6/1976 Ueki
4,278,737 A 7/1981 Creffield et al.
(Continued)

FOREIGN PATENT DOCUMENTS

JP 2006328467 A * 12/2006 ..... C25D 11/04
WO 2006072804 A2 7/2006
WO 2009069111 A2 6/2009

OTHER PUBLICATIONS

Whelan et al., "Sol-Gel Sealing Characteristics for Corrosion Resistance of Anodised Aluminium," Surface & Coatings Technology (2013), vol. 235, pp. 86-96. (Year: 2013).*
(Continued)

*Primary Examiner* — Edna Wong
(74) *Attorney, Agent, or Firm* — Stinson Leonard Street LLP

(57) ABSTRACT

A method for producing a multi-layer anodic coating on a metal is described. The method comprises the steps of (i) placing the metal in a first electrolytic solution and applying a current to form a first anodic layer having a barrier region; (ii) reducing the applied current to cause a reduction in thickness of the barrier region; and (iii) placing the metal in a second electrolytic solution and applying a current to form a second anodic layer.

32 Claims, 8 Drawing Sheets

(51) Int. Cl.

| | |
|---|---|
| ***C25D 11/12*** | (2006.01) |
| ***C25D 11/02*** | (2006.01) |
| ***C25D 11/04*** | (2006.01) |
| ***C25D 11/06*** | (2006.01) |
| ***C25D 11/08*** | (2006.01) |
| ***C25D 11/16*** | (2006.01) |
| ***C25D 11/24*** | (2006.01) |

(52) U.S. Cl.
CPC ..... *C25D 11/08* (2013.01); *C25D 11/16* (2013.01); *C25D 11/24* (2013.01); *C25D 11/246* (2013.01)

(58) Field of Classification Search
USPC ..... 205/171, 174, 175
See application file for complete search history.

(56) References Cited

U.S. PATENT DOCUMENTS 4,566,952 A 1/1986 Sprintschnik et al.
4,687,551 A 8/1987 Furneaux et al.
4,737,246 A * 4/1988 Powers ..... C25D 11/08 205/116
5,486,283 A * 1/1996 Mnich ..... C25D 11/12 205/174
5,820,740 A * 10/1998 Le ..... B64G 1/226 205/171
2005/0150771 A1 7/2005 Kock et al.
2014/0326151 A1 * 11/2014 Namba ..... B41N 3/034 101/459

OTHER PUBLICATIONS

Keller et al., "Structural Features of Oxide Coatings on Aluminum," Journal of the Electrochemical Society (Sep. 1953), vol. 100, No. 9, pp. 411-419. (Year: 1953).*
International Search Report issued for PCT/EP2014/078700, dated Mar. 25, 2015, 4 pages.
Written Opinion issued for PCT/EP2014/078700, dated Mar. 25, 2015, 7 pages.
Pakes, A., et al., "Development of Porous Anodic Films on 2014-T4 Aluminium Alloy in Tetraborate Electrolyte," 2003, Corrosion Science, 45:1275-1287, 13 pages.
Whelan, M., et al., "Sol-Gel Sealing Characteristics for Corrosion Resistance of Anodised Aluminium," 2013, Surface & Coatings Technology, 235:86-96, 11 pages.

* cited by examiner

METHOD FOR FORMING A MULTI-LAYER ANODIC COATING

REFERENCE TO RELATED APPLICATIONS

The present application is a 371 National Stage Application of International Application No. PCT/EP2014/078700, filed Dec. 19, 2014, and claims priority to application no. GB 1322745.9, filed Dec. 20, 2013, the entire disclosures of which are incorporated herein by reference.

FIELD

The present invention relates to a method for forming a multi-layer anodic coating, in particular, a duplex anodic layer, on an anodisable metal.

BACKGROUND

Aluminium is used extensively for lightweight structures such as automotive and aerospace components where a combination of strength and corrosion resistance is essential. Aluminium owes its inherent corrosion resistance to a naturally occurring passive oxide which forms on the metal when exposed to the atmosphere. The thickness of the oxide layer is in the nanometer range which limits the performance of the metal against extreme mechanical and chemical attack. Electrochemical processes have been investigated with a view to producing coatings on such metals to enhance the strength and corrosion resistance of the metals.

Anodising is a well known electrochemical process for coating metals whereby a metal component, such as an aluminium work piece, for example, is submerged in a bath of an electrolytic solution. The work piece to be coated acts as a positive electrode and a direct current is applied. This results in an anodic coating comprising a porous layer of aluminium oxide being formed on the work piece. The thickness of the aluminium oxide is increased by the anodising process through an electrochemical reaction in acidic electrolytes such as sulphuric, phosphoric or oxalic acids. The process is commonly used to increase corrosion resistance and adhesion properties of the aluminium surface for a variety of applications.

The anodised aluminium oxide layer is nanoporous in structure with a self-assembled, hexagonal array of pores extending from the surface of the oxide to a thin barrier layer at the metal-metal oxide interface. The oxide growth and nanopore formation mechanism is a result of flow of anodic alumina in the barrier layer region due to the combination of growth stresses and field assisted plasticity. The stresses that drive the flow of material are due to electrostriction of the oxide layer which is plasticised under the electric field. The flow of material proceeds from the barrier layer into the pore walls forming $Al_2O_3$ columns in a self-assembled structure.

The anodic coating forms part of the metal but it has a porous structure which enables further treatments to be applied. For example, top coats and lacquers may be incorporated in the coating. Following the anodising process, the pores of the anodic layer need to be closed. If the pores are not sealed, the surface could have poor corrosion resistance.

For anti-corrosion applications, sulphuric acid anodising (SAA) is most commonly employed. A known significant advantage of SAA anodic layers is, for example, the ability of the pores of the anodic layer to close by surface hydration resulting in improved barrier properties thereby providing corrosion resistance. Hydration on the SAA surface proceeds rapidly after anodising and can be accelerated by hydrothermal treatment to achieve increased corrosion protection while also entrapping any applied inhibitors or dyes. Both natural and hydrothermally induced hydration results in pore blocking near the surface of the anodised layer. Hydration continues naturally over time as the pore closing effects move down the pore channel towards the metal surface. This continued hydration, termed "auto-sealing", results in an increase in the barrier properties of the anodic layers even during exposure to aggressive environments. Such a feature is responsible for the excellent long term and accelerated corrosion resistance of sulphuric acid anodised layers on copper-free wrought alloys.

However, in the case of copper-containing alloys, the protective properties provided by anodic layers formed by sulphuric acid anodising is reduced by the inclusion of copper ions within the oxide network. The presence of copper, as well as the random orientation of the pores, leads to difficulties with hydration sealing. To improve the corrosion protection on copper containing alloys, anodising processes have been developed including boric-sulphuric (BSAA) and tartaric-sulphuric (TSAA) acid anodising for corrosion and adhesive bonding applications.

Chromate based anodising processes and sealing processes are generally regarded as the target performance benchmarks for any developed anodising technology. However, due to the carcinogenic nature of these materials, the use of chromate based processes are currently restricted or being eliminated from anodising industries.

Anodising procedures currently used in the art include the use of mixed tartaric sulphuric acid (TSA) which has been shown to produce corrosion resistance and fatigue resistance equivalent to chromic acid anodising. However, on the other hand, due to surface hydration and small pore size of the resulting oxide layer, the adhesion of top coats and lacquers has been found to be inferior to that achieved using chromic acid anodising.

The conventional phosphoric acid anodising process is well known as having excellent adhesion properties, comparable to chromic acid anodising. However, this treatment imparts extremely poor corrosion resistance to the metal.

In order to achieve a balance of adhesion and corrosion resistance, duplex anodic layers have been investigated.

International Publication No. WO 2006/072804 relates to a method for the formation of anodic oxide films on aluminium or aluminium alloys. The anodic oxide coating disclosed in WO 2006/072804 is suitable for adhesive bonding of aluminium alloy structures. A duplex anodising procedure is described which involves the use of a mixed sulphuric phosphoric acid anodising step followed by a sulphuric acid treatment. The mixed bath is used to achieve a balance between hydration resistance and anodising voltage. However, in the process disclosed, the voltage used for the first anodising step is limited due to the mixture of acids used. In particular, when anodising in the presence of sulphuric acid, a lower voltage must be used compared to that used when anodising in the presence of phosphoric acid. The voltage used in the anodising step described in WO 2006/072804 is limited due to the mixture of sulphuric acid and phosphoric acid. The process disclosed in WO 2006/072804 also suffers from the disadvantage that the duplex anodic layer formed is not optimised for adhesion as the pore size is relatively small. In order to prevent pore closure due to hydration and accordingly to retain the adhesion properties of the surface, a system comprising pores having a large diameter is required.

A technology similar to that disclosed in WO 2006/072804 is described in US20050150771 in which, again, the initial anodising procedure requires a mixed sulphuric phosphoric acid anodising electrolyte to achieve lower forming voltage. It is notable that the forming voltages are limited to below 25V. However, optimum surface adhesion is not achieved as this can only be provided by sulphate free anodised layers formed under larger potentials. Thus, again, the duplex anodic layer formed is not optimised.

Thus, despite the development of anodising treatments for copper rich aluminium alloys, the corrosion protection afforded by the anodic layers is limited and does not provide the desired corrosion resistance.

In addition, many aerospace and automotive companies are utilising sol-gel chemistries as a replacement for hexavalent chrome anodising and conversion coatings. For corrosion resistance of anodised aluminium using sol-gel based sealers, the combination of both natural hydration of the surface as well as penetration of the sol-gel into the pores of the anodic is required for full performance. However, there are some inherent problems associated with the combination of sol-gel chemistry and current anodising processes. Migration of sol-gel materials into the aluminium oxide pores can also be limited.

Accordingly, there is a need for an improved method for the production of anodic coatings which are capable of imparting desirable corrosion resistance as well as the desirable adhesion and abrasion properties to an anodisable metal. Furthermore, the anodic layer requires optimisation in order to achieve full encapsulation of materials applied to the anodic layer(s) such as sol-gel sealers without affecting the desired properties of the anodic layers. Such optimised corrosion resistance; and optimised adhesion and abrasion properties as well as optimised for achieving full encapsulation of applied materials is not achieved by the known processes.

SUMMARY OF THE PRESENT INVENTION

Accordingly, the present invention provides a method for producing a multi-layer anodic coating on a metal which comprises the steps of:

(i) placing the metal in a first electrolytic solution and applying a current to form a first anodic layer having a barrier region;

(ii) reducing the applied current to cause a reduction in thickness of the barrier region; and (iii) placing the metal in a second electrolytic solution and applying a current to form a second anodic layer.

It will be understood that reducing the applied current does not equate to removing the applied current entirely.

The applied current in step (ii) may be reduced by an amount up to 50% of the steady state current. The reduction in current results in a reduction in the steady state voltage.

The method according to the present invention suitably comprises the step of repeating step (ii) sequentially for a period of time such that a steady state voltage is obtained.

Preferably, step (i) of the method of the present invention comprises a first anodising process having a final forming voltage and step (iii) comprises a second anodising process having an initial forming voltage; wherein following step (ii), the final forming voltage of the first anodising process is less than the initial forming voltage of the second anodising process.

The thickness of the coating is determined by the level of electrical current and the length of time it is applied. The process described herein provides a barrier layer thinning technique. The term "barrier layer thinning" as used herein means a technique whereby the anodising current in the first anodising process is suddenly reduced to a lower value. This lower value may be half the value of the anodising current prior to the reduction. This reduction in steady state anodising current takes the system out of its first steady state anodising voltage and progressively lower voltages are achieved until the system reaches a second steady state. As the thickness of the barrier layer is dependent on the anodising voltage, the reduction in current effectively causes a thinning of the barrier layer. The method according to the present invention utilises this barrier layer thinning technique at the end of the first anodising step. This results in a lowering of the forming voltage and allows for a subsequent low forming voltage, second anodising step to be conducted.

The final forming voltage of the first anodising process is preferably in the range 2V to 10V.

The method according to the present invention has the advantage that it is more flexible than those processes of the prior art due to the fact that the initial or first anodising step can be carried out using large voltages (for example, in the region of hundreds of volts) and fast anodising rates (for example, 0.05-1 μm/min), while the second anodising step can still be conducted as a low voltage process. Another advantage of the present invention is that the second anodising step achieves growing a protective oxide layer as distinct from reducing the thickness of the barrier layers as in the prior art. Furthermore, the films produced using the method of the present invention have markedly different chemical and structural features from those achieved by the processes of the prior art. These chemical and structural features will be described further hereinbelow.

The method according to the present invention utilises a duplex anodising process which achieves the optimisation of the anodic layers and hence, the surface preparation of an anodisable metal, for example aluminium. The method of the present invention has the advantage that it overcomes the limitations between the respective forming voltages for the phosphoric acid anodising (PAA) and sulphuric acid anodising (SAA) treatments so that the parameters of each step may be chosen independently.

The first and second anodising steps can be carried out using any electrochemical process that forms an appropriate porous oxide layer on the metal. The formation of the oxide can be conducted simultaneously with an additional surface electrochemical process. For instance, the formation of the oxide can be accompanied simultaneously by an electrobrightening process. Electrobrightening of aluminium in acidic electrolytes is known to produce a porous oxide film similar to the anodising process. The parameters of the electrobrightneing process can be tailored to achieve reduction in surface roughness, to increase surface reflectance, while simultaneuously forming the anodic oxide required for the duplex anodic structure.

Another example of a simultaneous electrochemical process is the tailoring of the anodising procedure to form the porous oxide while simultaneously consuming the native oxide formed on the aluminium surface. Additionally, the parameters can be tailored to remove intermetallics from the aluminium matrix that oxidising at a slower rate than the aluminium metal. Such intermetallics can cause defect in the formed anodic layers which is problematic when optimum corrosion protection is required. In one embodiment of the present invention, the first anodic electrochemical treatment is used to prepare the aluminium surface and remove any intermetallics; and the second electrochemical process is then be conducted with the formed oxide thereby exhibiting optimum protection properties.

An advantage of the process according to the present invention is that it reduces the number of process steps therefore needed to prepare a metal surface. As the initial anodising treatment consumes the metal surfaces and any intermetallics, the surface is sufficiently prepared for the second treatment. The integrity and barrier properties achieved by the first anodising step are not particularly important, as the resulting first anodic layer is used as an adhesion and abrasion promoter; the integrity of the second anodic layer formed by the second anodising step being aided by the first anodic layer pre-treatment. This feature has the advantage of removing the requirement for up to six chemical treatments from a typical known anodising and electrobrightening cycle.

The multi-layer anodic coating according to the present invention suitably comprises a duplex anodic layer. The duplex anodic layer structure is formed by the double anodising process described herein which is conducted in two different electrolytes under conditions such that optimisation of the structure of the respective layers and of the overall duplex layer is achieved for optimised corrosion resistance together with optimised adhesion and abrasion properties as well as optimised for achieving full encapsulation of applied materials such as additional treatments that may be added to the exposed surface of the multi-layer anodic coating, such treatments possibly being formulated in the form of sol-gels.

The anodising method of the present invention can be adapted to use any suitable anodising solution.

Multi-acid systems comprising two or more acids such as tartaric sulphuric acid, boric sulphuric acid or any other suitable mixed acid electrolytes may also be used. Additional ions such as tartrates or borates, for example, can be included to impart better corrosion resistance and physical properties in the aluminium oxide matrix. Furthermore, the low film thickness, suitably in the region of approximately 2 to 3 microns produced from these systems have been shown to be advantageous for corrosion resistance and fatigue resistance.

The first anodising solution for carrying out the first anodising step of the method of the present invention comprises a suitable acid. Suitable acids may, for example, be selected from the group consisting of phosphoric acid, oxalic acid, sulphuric acid solution and mixtures thereof.

The second anodising solution for carrying out the second anodising step of the method of the present invention comprises a suitable acid. In the case of the second anodising solution, the suitable acid may, for example, be selected from the group consisting of sulphuric acid solution, oxalic acid solution, tartaric acid solution, boric acid solution and mixtures thereof.

The first and second anodising solutions may be kept at a temperature in the range 0° C. to 90° C.; ideally, in the range 0° C. to 70° C.; preferably, 5° C. to 40° C., more preferably, 15° C. to 25° C., most preferably about 20° C.

The method according to the present invention has the significant advantage, of allowing the incorporation of the anticorrosion and fatigue resistance properties of tartaric sulphuric acid anodising (TSA) as well as the adhesion and abrasion properties of the phosphoric acid anodising (PAA) treatment on the same surface.

In one aspect of the present invention, the first anodising solution comprises from 1 to 20% phosphoric acid and the second anodising solution comprises from 1 to 30% sulphuric acid.

The first anodic layer may comprise a phosphoric acid anodic layer comprising pores that are referred to as relatively large pore diameters i.e. having a diameter in the range 50 to 150 nm, preferably in the range 50 to 100 nm, most preferably in the range 75 to 100 nm.

The second anodic layer may comprise a sulphuric acid anodic layer comprising pores that are referred to as relatively small pore diameters i.e. having a diameter in the range 10 to 25 nm preferably in the range 15 to 25 nm.

The two layers comprising the first anodic layer and the second anodic layer, with the first anodic layer comprising pores having relatively large pore diameter size; and the second anodic layer comprising pores having relatively small pore diameter size is referred to herein as a duplex layer or duplex anodic layer or duplex structure.

This duplex layer structure allows impregnation of dyes or other compounds into the relatively smaller pores of the SAA while the surface of the SAA allows the required hydration layer. The larger pores of the PAA are advantageous for encapsulating the sol-gel materials, or any other applied coatings or adhesives for enhanced adhesion and corrosion protection.

In one aspect of the present invention, step (i) of the method is conducted at a voltage of 10 to 200V preferably 30 to 50V, more preferably 40V. This is a preferred voltage for carrying out the first anodising step which is preferably carried out in phosphoric acid to form a phosphoric anodised layer.

It will be appreciated that the time required for the first step may vary with voltage and other parameters but a suitable time is between 1 to 240 minutes. The method may further comprise the step of sealing an interface between the first anodic layer and the second anodic layer. In a preferred aspect, the first anodic layer comprises a phosphoric acid (PAA) layer and the second anodic layer comprises a sulphuric acid (SAA) layer. The sealing creates a barrier at the interface that separates the two anodic layers. This advantageous sealing is discussed in more detail hereinbelow.

The method according to the present invention may also improve the process for the application of sol-gels or other top coats to anodic layers. The anti-corrosion properties of the top coat material is therefore not as critical because enhanced corrosion resistance is provided by the bottom anodic layer of the duplex structure. For example, the level of protection of provided by a Si—Zr sol-gel sealed anodic layer is appropriate to be considered as a replacement for Chromium based anodising and sealing technologies.

The sol-gel process can be used to form nanostructured inorganic films (typically 200 nm to 10 μm in overall thickness) that can be tailored to be more resistant than metals to oxidation, corrosion, erosion and wear while also possessing good thermal and electrical properties.

The surface of the phosphoric acid layer is compatible for coating or adhesive bonding as per conventional processes.

Preferably, the coating comprises a sol-gel. The sol-gel coating may be selected from the group consisting of an inorganic, organic or hybrid precursors such a metal oxides and organically functionalised silanes. The sol-gel coating may also contain active corrosion inhibitors such as nitrogen based heterocycles. An example of a suitable Si—Zr sol-gel is provided in WO/2009/069111, the entire contents of which are hereby incorporated by reference.

The method may further comprise the step of applying a sealing or corrosion inhibiting treatment to the sulphuric acid layer. The sealing treatment may include hydrothermal, nickel acetate, nickel fluoride, sodium silicate or other conventional sealing treatments. Corrosion inhibitors may also be included in the sulphuric acid layer. Examples of suitable corrosion inhibitors may be selected from the group consisting nitrogen heterocycles triazoles, triazines and tetrazines.

In another aspect, the present invention provides a multi-layer anodic coating comprising a duplex anodic structure comprising a phosphoric acid anodic layer and a sulphuric acid anodic layer, wherein said phosphoric acid layer comprises pores having a diameter in the range 50 to 150 nm, preferably, 50 to 100 nm; and said sulphuric acid layer comprising pores having a diameter in the range 10 to 25 nm, preferably 15 to 25 nm.

The method of the present invention has the advantage that it achieves a structure within the first anodic layer (preferably, the anodic layer formed in the the phosphoric acid (ie. the phosphoric acid anodic layer) has a structure of pores having openings formed at intervals along the longitudinal axis of the pore such that adjacent pores are in fluid connecection thereby allowing a material such as a sol-gel to flow laterally between one columnar pore and a neighbouring columnar pore such that lateral porosity is achieved where heretofore only longitudinally porous structure was achieved. This structure has the highly desirable effect of enabling full encapsulation of a material such as a sol-gel throughout the first anodic (PAA) layer. Thus, a highly desirable and advantageous feature of the phosphoric acid anodising process conducted in the method according to the present invention is the lateral interporosity produced in the aluminium oxide network in addition to the longitudinal porosity. Thus, a 3D network of pores is formed in the first anodic layer (preferably, comprising PAA) which aids penetration, encapsulation and adhesion of any applied coatings or adhesives.

The duplex anodic structure formed by the method described herein enables encapsulation of sol-gel materials while the surface hydration is unaltered. The phosphoric acid layer in the duplex structure may further comprise a sol-gel.

1. Advantageous Features of the Optimised Multi-Layer Anodic Layer of the Present Invention:

The oxide layers provided by the present invention achieve optimised adhesion to any applied liquids, adhesives or coatings.

- For optimum adhesion, the surface oxide must be comprised of sulphate free anodic alumina. The presence of sulphate ions results in an increase in the hydration rate of the surface which can cause the pores to close and inhibit adhesion to the oxide. Additionally, application of coatings to sulphuric acid anodised layers can delaminate when exposed to humid conditions. Anodic layers comprising phosphate ions only have shown to provide excellent adhesion to a range of coating materials.
- Anodic layers with pore diameter characteristic of phosphoric acid anodised layers for instance at least 50-150 nm. The large pore diameters allow better penetration of coatings and adhesives into the alumina matrix.
- For encapsulation purposes, the layers would be required to be at least 3-5 μm for thin film coatings such as sol-gel. For larger coating thickness, such as those with paints the required anodic layer thickness may be up to 50 μm.

Additional Features of the Structure of the Anodic Layers of the Present Invention Produced by the Method of the Present Invention:

Selective Sealing of Duplex Layers

The ability to apply sealing treatments to the base oxide of the duplex structure without closing the pores of the (top) surface oxide is a key element of the developed technology. Traditional treatments such as hydrothermal treatment or nickel based sealing can be conducted to increase the corrosion resistance of the base anodic layer while retaining the open pore and adhesion properties to the surface anodic layer. This can only be achieved by ensuring that the pore diameters of the surface oxide are appropriately large and that this layer is formed in electrolytes that are sulphate free.

Three Dimensional Porosity of Formed Layers

By selecting appropriate anodising conditions, the oxide film can be grown to produce pores that exhibit openings or channels in the pore walls as shown in FIG. 9 of the attached drawings. The combination of acid concentration, temperature and anodising voltage results in a nanoporous three dimensional aluminium oxide network. Pore wall voids are visible throughout the layer leading to interconnectivity between adjoining pores.

By achieving this lateral porosity, a three dimensional porous network is formed. This network can be used as a host matrix for any applied coatings. This encapsulation method has shown particular application with sol-gel coatings. The sol-gel materials can easily migrate through the aluminium oxide network resulting in a dense oxide-sol-gel composite layer as seen in FIG. 10.

The sulphuric acid anodic layer in the duplex structure may further comprise a corrosion inhibitor.

In a further aspect, the present invention provides an aluminium component comprising a multi-layer anodic coating produced by the method of the present invention. The aluminium component suitably comprises a multi-layer anodic coating comprising a duplex anodic structure comprising a phosphoric acid anodic layer comprising pores having a diameter in the range 50 to 150 nm, preferably in the range 50 to 100 nm; and a sulphuric acid anodic layer comprising pores having a diameter in the range 10 to 25 nm; preferably in the range 15 to 25 nm.

The multilayer, in particular, duplex anodic layer structure produced by the process according to the present invention allows any coating material to be successfully incorporated into the anodic layer, retaining all the natural properties of both the coating and anodised surfaces. This combination can be used commercially in aerospace, automotive and architectural applications, amongst others.

It is to be understood that while the following description refers to duplex layer structure and method of formation of a duplex layer, it is to be understood that the method of the invention can be employed to form a multi-layer structure and is not limited to duplex layers.

BRIEF DESCRIPTION OF THE DRAWINGS

The present application will now be described more particularly with reference to the accompanying drawings in which a duplex anodic layer structure, and its method of formation, will be described by way of example only.

DETAILED DESCRIPTION

Figure 1:
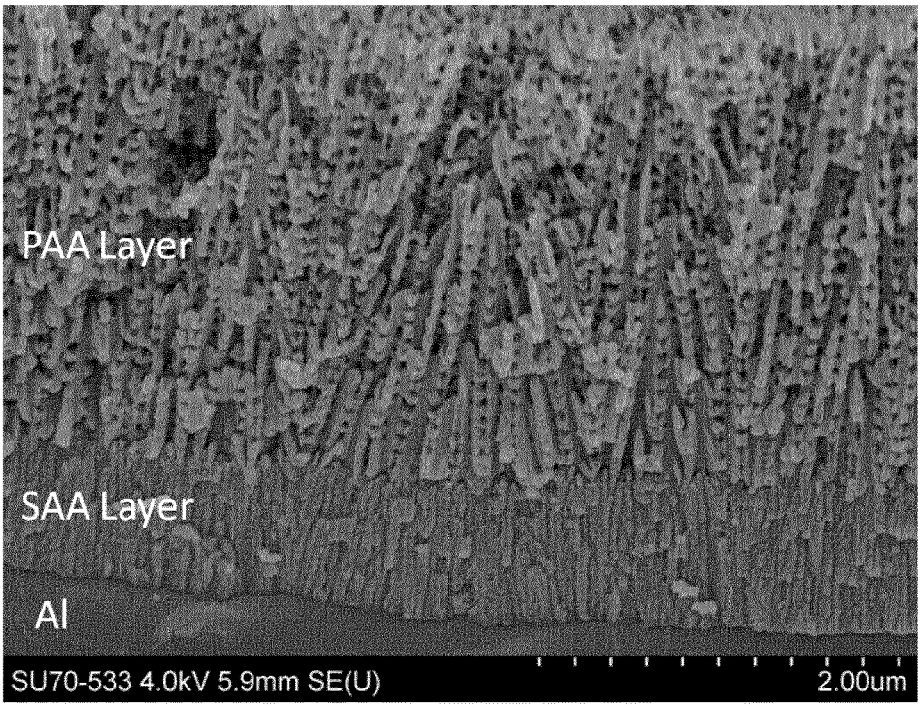
FIG. 1 is an electron microscope image showing a duplex anodic layer formed on a clad Aluminium alloy (AA2024-T3)

The present invention describes a method of forming a multilayer, in particular, duplex, porous structure on an anodisable metal. The method utilises an anodising process which is suitable for producing multilayer, in particular, duplex, anodic structures on the surface of a metal. The multilayer, in particular, duplex anodic structure optimises the surface preparation of a metal or alloy surface. The method described herein is particularly suitable for use as a surface preparation technique prior to sol-gel coating deposition on a metal or alloy, for example aluminium.

The method according to the present invention enables the production of a duplex anodic layer structure which enables a combination of adhesion and corrosion resistance to be achieved. The duplex structure comprises first and second anodic layers having a variable pore size. The process for the production of the duplex anodic structure involves treating an anodisable metal in two separate anodising baths to form firstly, a porous anodic oxide layer having a large diameter pore system, for example 75-100 nm, and secondly, a second anodic layer having a smaller diameter pore system. The large diameter pore system exhibits a low level of hydration. This results in a surface treatment that has excellent adhesion and abrasion properties and a desirable hydration resistance. It will be appreciated that any suitable electrolyte may be used as the first anodising solution. An example of a suitable electrolyte is phosphoric acid. The incorporation of phosphate ions into the anodic layer results in a minimal rate of hydration. A second anodic layer may then be formed between the initial anodisation layer and the base metal. This layer may be tailored to achieve optimum corrosion resistance. A small pore size (10-20 nm) is necessary for the second anodic layer and it enables a fast rate of hydration. The skilled person will appreciate that any suitable electrolytic solution may be used for the second anodising step. An example of a suitable electrolyte is sulphuric acid.

The smaller diameter pore system of the second anodic layer can be sealed by conventional processes such as hydrothermal sealing which converts aluminium oxide to aluminium hydroxide. The more volumous aluminium hydroxide results in a swelling closed of the pores increasing barrier protection of the anodised layer. Other methods of sealing based on heavy metal compounds or silicates can also be utilised. In all cases the open pore structure of the first anodised layer remains open.

It will be appreciated that the features and properties of the anodic oxides produced are dependent on many parameters including the aluminium alloy, electrolyte type and anodising conditions, for example, temperature and current density. Many structural changes to anodic layers can be conducted by altering the electrochemical parameters. For example lower electrolyte concentration results in better fatigue resistance as the film thickness is lower, lowering electrolyte temperature generally results in a harder oxide layer produced, and additional ions such a tartrates or borates can be introduced to the electrolytes to impart better corrosion resistance and physical properties.

For corrosion resistance of anodised aluminium using sol-gel based sealers, the combination of both natural hydration of the surface as well as penetration of the sol-gel into the pores of the anodic is generally required for full performance. As some sol-gel chemistries can inhibit hydration of anodic layers the natural protection properties of anodic layers is prevented. In addition some sol-gel chemistries do not penetrate the pores of sulphuric acid anodised (SAA) aluminium due to large particle size. Phosphoric acid anodised (PAA) aluminium with a larger pore size will allow penetration of such sol-gel however it does not allow hydration due to the chemical nature of the anodic finish.

In order to achieve both hydration and sol-gel penetration the duplex anodising process is utilised. The interface between the dual layers can be sealed by the hydration process. The duplex structure can be used as a standalone treatment for the metal for combined corrosion and adhesion properties. For optimum corrosion protection a coating can be applied to the duplex structure and encapsulated in the top anodic coatings. Suitable coatings include primers, topcoats and lacquers. Sol-gel derived coatings are particularly convenient as the entire sol-gel coating thickness can be encapsulated in the top anodic layer. Suitable sol-gel materials include any water or solvent based sol-gel formulation synthesised from silicon alkoxides or any other metal alkoxides.

Examples of components which may be treated with the process according to the present invention include generally aluminium components to be employed in an outdoor environment where a degree of corrosion resistance is required. These would include for example components used in the aerospace industry, automotive industry and building components, such as scaffolding, exterior trim and window frames.

The duplex structure may be tailored to suit particular applications, end uses. The following is an example of an application of the process according to the present invention wherein a duplex anodic layer was produced and sol-gel encapsulated into the structure thereof to enhance the properties thereof. The duplex anodising process according to the present invention utilises the natural corrosion resistance properties of sulphuric acid anodising with the adhesion and hosting properties of phosphoric acid anodising. The anodising process and sol-gel sealed surfaces produced in the following example were characterised using field emission scanning electron microscopy, energy dispersive x-ray spectroscopy. Performance of the sol-gel treated anodic layers was evaluated by neutral salt spray testing, electrochemical impedance spectroscopy and rain erosion testing. Aspects will now be discussed in more detail below with reference to the following non examples. The Si—Zr sol-gel referred to below in the Example(s) is the subject of International patent application no. WO2009069111 A2, the disclosure of which is incorporated herein.

Example 1

Two sol-gel coatings were synthesised and used as sealers for the anodic layers.

Phenyl Functionalised Sol-Gel

The silane precursor Phenyltriethoxysilane (PhTEOS 98%) (VWR International Ltd (Irl), 98%) was hydrolysed under acidic conditions by adding 5.2 ml of 0.04M $HNO_3$ to 50.6 ml of silane precursor. 30.6 ml of absolute ethanol was immediately added to the mixture and left to stir for 45 minutes. 13.6 ml of de-ionised water was then added dropwise and the solution was left to stir for 24 h before use. The final molar ratio for the formulation was Silane:Ethanol: Water—1:2.5:3.5.

Silane-Zirconium Hybrid Sol-Gel

The silane precursor, 3-(trimethoxysilyl) propylmethacrylate (MAPTMS) (Sigma Aldrich, Irl, Assay (99%) was pre-hydrolysed using 0.01 N $HNO_3$ for 45 min (A). Simultaneously, zirconium (IV) n-propoxide (TPOZ) (Sigma Aldrich, Ireland, Assay ~70% in propanol) was chelated using Methacrylic acid (MAAH)(Sigma Aldrich), at a 1:1 molar ratio for 45 minutes (B) to form a zirconium complex. Solution A was slowly added to solution B over ten minutes. Following another 45 min, water (pH 7) was added to this mixture. The molar ratio of Si/Zr in the final sol is 4:1 and Si/$H_2O$ is 1:2. After 24 hours of stirring 3,6-Di-2-pyridyl-1,2,4,5-tetrazine (DPTZ) was added as a corrosion inhibitor at a concentration of 0.3% w/v of MAPTMS precursor.

1.1 Pre-Treatment and Anodising

AA2024-T3 (Si 0.5%, Fe 0.5%, Cu 0.8-4.9%, Mg 1.2-1.8%, Mn 0.3-0.9%, Cr 0.1%, Zn 0.25%, Ti 0.15% other 0.15%, Al remainder) aluminium panels (150 mm×100 mm×0.6 mm) were sourced from Amari (Irl). The panels were degreased in acetone, etched in Novaclean® 104 for 45 secs, rinsed and etched in Novox® 302 for 90 seconds. Novaclean and Novox were purchased from Henkel (Ger). Clad 2024-T3 aluminium panels (150 mm×75 mm×0.6 mm) were provided from industrial sources. Acetone, NaOH, $HNO_3$, $H_2SO_4$ and $H_3PO_4$ were purchased from Sigma Aldrich IRL. The panels were degreased in acetone, etched in 10% NaOH at 40° C. for 50 seconds and rinsed in de-ionised water. The panels were then treated in 50% $HNO_3$ at room temperature for 90 seconds to remove any intermetallics from the surface prior to anodising.

Anodising solutions were prepared by diluting 98% $H_2SO_4$ w/v and 95% $H_3PO_4$ in deionised water to a concentration of 25% w/v and 10% w/v respectively. Three anodising procedures were conducted:

1) Phosphoric Acid Anodising (PAA)—60 minute phosphoric acid anodising at constant 40V.
2) Sulphuric Acid Anodising (SAA)—20 minute sulphuric acid anodising at 1.5 A d/m$^2$ of aluminium surface area.
3) Duplex Anodising (DA)—PAA process was conducted as per procedure 1). At the end of the PAA cycle the anodising current was immediately reduced to half of its steady state value. As a result the anodising potential gradually decreased. Once the anodising voltage decreased to 10V the power was turned off. The surfaces were then rinsed in de-ionised water for 10 minutes to remove any residual electrolyte from the pores. The parts were then immersed in the sulphuric acid electrolyte. AA2024-T3 and Clad AA2024-T3 were anodised for 5 and 2 min respectively at 1.5 A d/m$^2$ of aluminium surface area. All anodised samples were rinsed for 20 min in de-ionised water and air dried prior to sol-gel application and testing.

For the PAA and SAA surfaces the sol-gel solution applied immediately after rinsing and drying by a dip coating process. The DA surface was hydrothermally sealed in de-ionised water at 95° C.±5 for 5 min prior to sol-gel dip coating. In all cases the dip cycle consisted of a 20 minute immersion step in the sol-gel solution following withdrawal at a rate of 10 mm·min$^{-1}$. The panels were then cured in an oven at 110° C. for 16 hours.

The pore dimensions and penetration of the sol-gel sealers into the anodic layers was determined by electron microscopy using a Hitachi SU 70 Field Emission Scanning Electron Microscope (FESEM). Anodic film cross sections were prepared by bending the aluminium sample over 180° to induce micro-cracks in the oxide layer. The cross section of the crack face exhibits the pore structure of the anodic alumina for imaging at 3-5 keV. For imaging purposes the samples were sputter coated with a 4 nm layer of Pt/Pd using a Cressington 208HR sputter coater.

Dot Map energy dispersive X-ray spectroscopy was conducted using an Oxford Instruments INCA X-MAX Energy Dispersive X-ray Spectrometer attached to the FESEM. Cross sections were prepared by mounting samples in epoxy resin before grinding and polishing to a mirror finish using progressive grades of carbide paper and polished to a 1 μm finish with a diamond solution. The polished cross sections were coated with 5 nm of carbon using a Cressington 208C Carbon evaporation coating unit. The Si and Al species are presented on a mixed DOT MAP to show the location of the sol-gel sealer in relation to the anodic oxide and aluminium substrate.

Electrochemical Impedance Spectroscopy (EIS) was conducted on the anodised and sealed AA2024-T3 and clad AA2024-T3 samples. EIS was carried out using a Solartron SI 1287/1255B system comprising of a frequency analyser and potentiostat operated by CorrView® and Z Plot® software. EIS electrochemical cells were made by mounting bottom-less plastic vials on to the exposed surface of the coated panel with amine hardened epoxy adhesive (Araldite®). The exposure electrolyte used was 3.5% w/v solution of $NaCl_{(aq)}$ The area of the coating exposed was 4.9 cm$^2$. All measurements were made at the open circuit potential ($E_{oc}$) with an applied 10 mV sinusoidal perturbation in the frequency range $1\times10^6$ to $1\times10^{-1}$ Hz (10 points per decade). EIS was performed with the anodised and sealed metal surface acting as the working electrode, silver/silver chloride (Ag/AgCl 3M KCl) electrode as the reference electrode and platinum mesh being used as a counter electrode.

To simulate the effect of rain erosion on the anodised and sol-gel sealed surface a Whirling Arm Rain Erosion test Rig (WARER) was used. Circular test samples were produced from the anodised and sol-gel treated samples by punch and die. The initial sample mass recorded. Mass measurements were repeated 3 times and taken using an Ohaus Explorer analytical balance with an accuracy of 0.1 mg. Inspection was also carried out for scratches and surface imperfections before testing. An individual test sample was then mounted at the end of the whirling arm. Tests were carried out at 178 ms$^{-1}$ and weight loss was recorded at four test durations; 15, 30, 45, and 60 min. The total test duration is based on the length of time the droplet system is active. The rainfall rate was 25 mmh$^{-1}$ and was monitored by a flowmeter. A cooling system was used to keep the ambient temperature constant during testing. After each test, the coupons were dried with compressed air and the mass recorded again.

In the example above, the duplex anodic structure produced by the method according to the present invention was utilised for sol-gel deposition. However it will be appreciated that it can be used for any applications requiring combined corrosion resistance of SAA layers with the adhesion properties of PAA.

The duplex oxides produced in accordance with the process according to the present invention are markedly different in structure from known duplex anodic structures. The current process produces duplex layers of unique structures as seen in the electron micrograph in FIG. 1. The duplex structure consists of a SAA layer approximately 1 μm next to the base metal. This layer exhibits all the natural features of conventional sulphuric acid anodising such as a small pore diameter as well as hydration and auto-sealing. As shown in FIG. 1, attached to the surface of the SAA is approximately 2 μm of oxide produced from the PAA process. The oxide exhibits a large pore diameter with a high level of interporosity. This interconnectivity between pores aids the penetration of liquids into the oxide network as the pressure increase within the pores due to the impinging liquid is easily dissipated.

Conventionally the forming voltage of the phosphoric acid anodising (PAA) process is larger than the sulphuric acid anodising (SAA) process. PAA can be conducted up to 200V while SAA processes generally do not exceed 25V. Due to this difference in forming voltages, burning and rapid dissolution of the metal can occur during the SAA cycle due to the high insulative effect of the previously formed PAA layer. The predominant structural effect of the forming voltage is the relative barrier layer thickness with nanolayers formed at approximately 1 nm/V. The barrier layer has been shown to be a significant feature in the electrochemical response of anodised layers. The critical requirement for the formation of a duplex anodic layer without burning of the surfaces is the reduction of the barrier layer thickness of the PAA layer prior to the SAA anodising.

Figure 2:
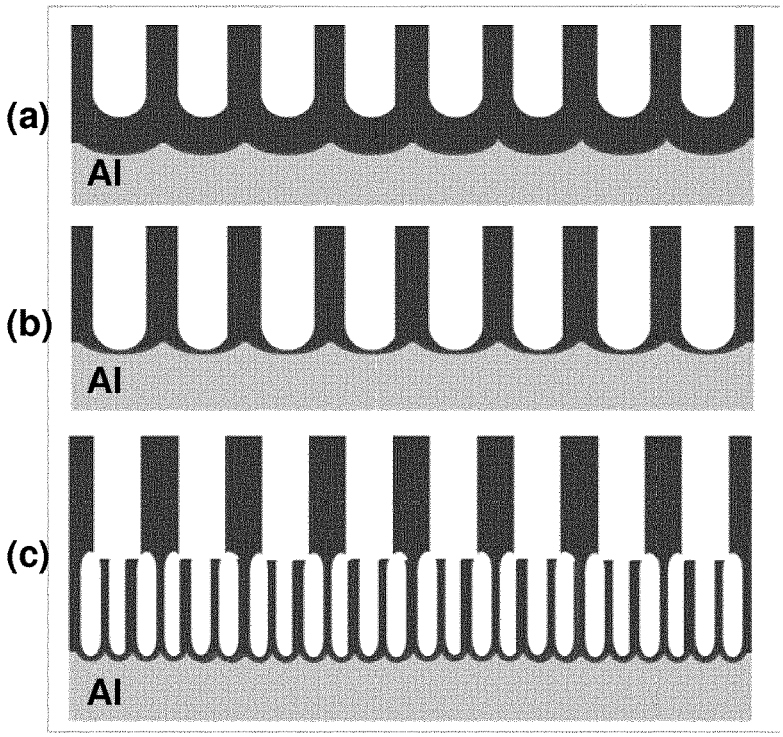
FIGS. 2(*a*), 2(*b*) and 2(*c*) show a schematic of the anodic layer structural change during the duplex anodising cycle.

As shown in FIG. 2 (*a*), after conducting the initial PAA process a porous layer with a relatively thick barrier layer is formed. The barrier layer formed at the base of the pores is approximately 40 nm in thickness. It is known that the charge transfer across the barrier is due to ionic conduction of the anodising electrolyte ions. If the barrier layer is not decreased in thickness prior to the SAA process the application of the second lower steady state anodising potential is not sufficient to allow ionic transfer across the barrier layer. Rather than distributing uniformly across the metal surface the current will conduct through the point of least resistance. The process of in-situ electrochemical thinning of the barrier layer prior to the second anodising process as used in the method according to the present invention is critical to prevent burning and dissolution of the metal surface due to large build up of current density at weak spots in the first anodic layer.

Figure 3A:
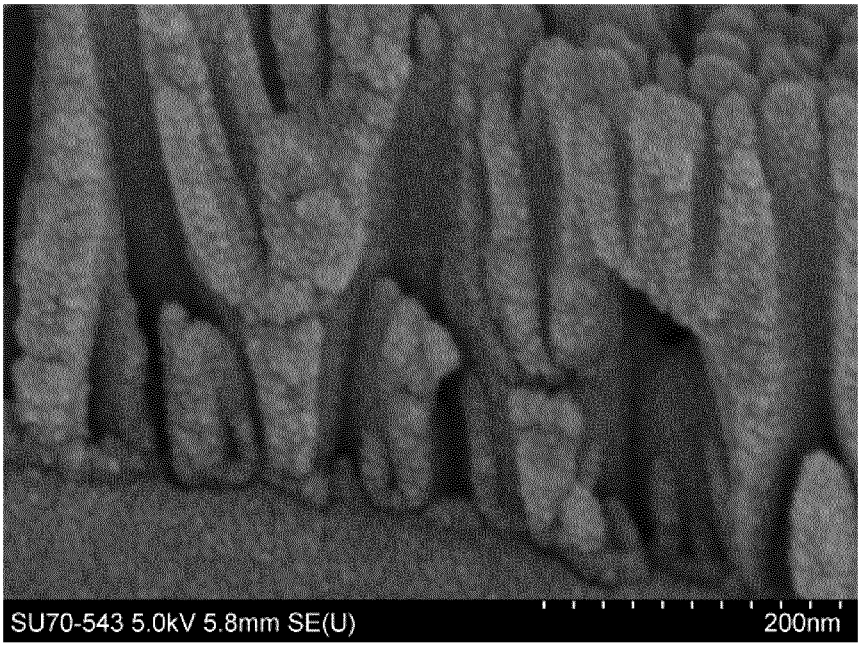
FIGS. 3(*a*) and 3(*b*) are electron microscope images showing the results of a barrier layer thinning process to 10V and 2V.
Figure 3:
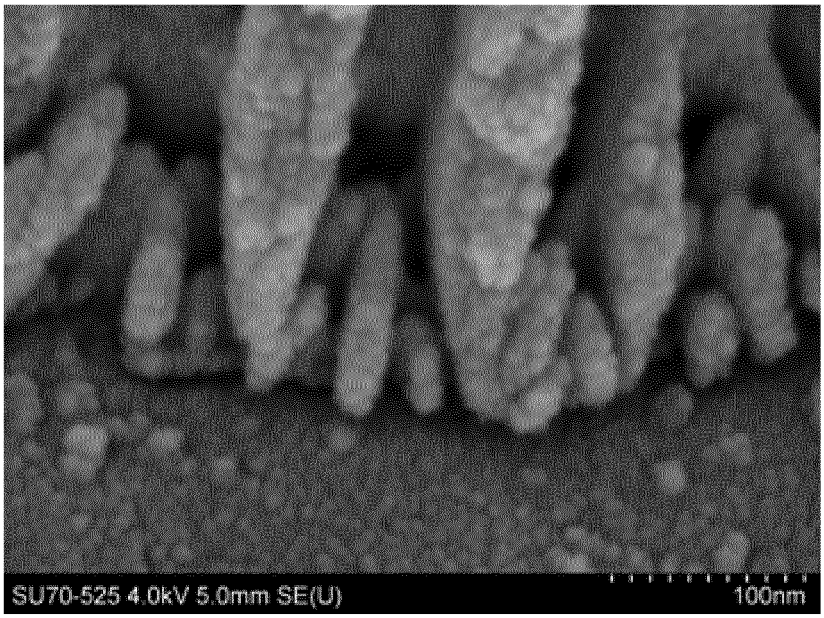

Barrier layer thinning (BLT) utilises the self-regulating nature of the anodising process. By rapidly limiting current at the end of the PAA process to half of the steady state anodising current the voltage will gradually decrease from the set 40V to a lower value. As shown in FIG. 2(*b*), during this decrease in voltage the self-regulating characteristic of the anodising process results in a corresponding thinning of the barrier layer Once a second steady state anodising voltage is reached the anodising current can again be halved which results in a further voltage drop and continued barrier layer thinning This step can be further repeated and by sequentially limiting the current in this way a final steady state voltage of the first anodising process can be lowered below the initial anodising voltage of the second anodising process. The results of conducting two rounds of current limiting procedure and three rounds of current limiting procedure on barrier layer thickness can be seen in FIGS. 3(*a*) and 3(*b*). FIG. 3(*a*) shows the results of a BLT process to 10V and FIG. 3(*b*) shows the results of a BLT process to 2V.

Figure 4:
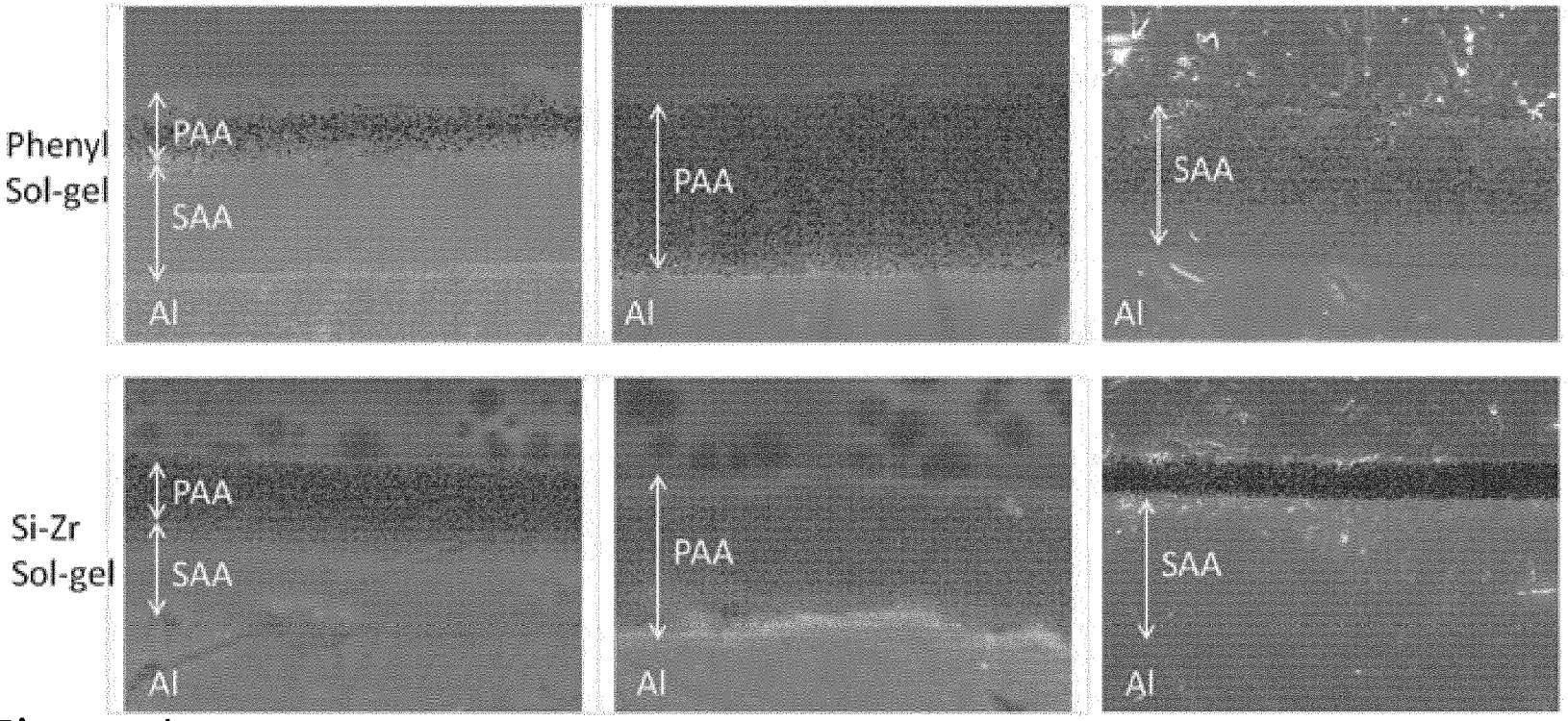
FIG. 4 shows pore penetration of sol-gel materials into anodised layers on AA2024-T3.

By lowering the forming voltage to 2V, it can be seen that the barrier is almost completely removed. Complete removal of the barrier may however compromise the interfacial adhesion between the anodised layers. Barrier layer thinning to a forming voltage of 10V is sufficient to allow the second anodising process to proceed. Once the BLT is achieved to an appropriate voltage the secondary sulphuric acid treatment can be conducted. FIG. 4 shows the duplex anodic structure formed. The top anodic layer (PAA) has a large pore diameter desirable for the encapsulation of applied top coatings such as paint, lacquers or sol-gels. As the PAA layer does not hydrate the pores do not close over time and adhesion is retained. As any applied top coating will be encapsulated in an aluminium oxide matrix the abrasion resistance will be greatly increased.

Once the BLT PAA anodised aluminium is immersed in the SAA electrolyte and a potential above 10V is applied ionic conduction across the barrier layer will occur. This results in a thickening of the barrier layer and SAA layer pore nucleation initiates. The SAA layer growth then proceeds in uninhibited. By applying an intermediate BLT step between the first and second anodising processes the parameters for each treatment can be chosen independently. This allows a great deal of flexibility in the thickness, pore features and chemical nature of the possible duplex structures that can be formed.

The bottom SAA layer contains all the conventional properties of an anodised layer and can be hydrated and sealed to achieve elevated corrosion resistance. This layer can also be used to encapsulate corrosion inhibitors, organic dyes or metal electrodeposits.

There are many factors that can determine if the sol-gel coating penetrates the porous anodic layers. PAA layer offer the best probability of penetration due to the large pore diameter however if the particle size is sufficiently small the sol-gel colloids can also migrate into the SAA layers. In order to determine the penetration properties of the sol-gel coatings on each anodic finish EDX dot map analysis was used to plot the Si and Al distributions. FIG. 4 exhibits the dot maps for the PhTEOS and Si—Zr sol-gel sealed SAA, PAA and DA films. The PhTEOS exhibits penetration into all surfaces. On the SAA layer, which contains the smallest pore diameter it is clear that the PhTEOS sealer has significant penetration into the oxide with Si intensity deteriorating rapidly at approximately 75% of the oxide thickness. The PAA is known to act as an excellent host for sol-gel materials and penetration can be seen throughout the layer. For the DA layer penetration occurs in the PAA layer without any migration into the SAA base layer due to the forced hydration and pore closing between the PAA and SAA layers. In the case of the Si—Zr sol-gel the large limited penetration into SAA network occurs. A surface coating only can be distinguished from FIG. 1. Similarly to the PhTEOS the Si—Zr sol-gel penetrates the PAA networks of the single and duplex anodised layers.

Anodising is often used to increase the surface hardness and abrasion resistance of aluminium alloys. By incorporating the sol-gel coating into the aluminium oxide network the elevated mechanical properties are afforded to the sol-gel coating. This will improve the hardness, abrasion resistance and impact resistance of the sol-gel coatings. A significant advantage of increased mechanical performance for the aerospace industry is the decreased effect of rain erosion.

Erosion of aerospace grade aluminium alloys by impinging water droplets is a significant issue especially during aircraft take-off and landing.

Figure 5:
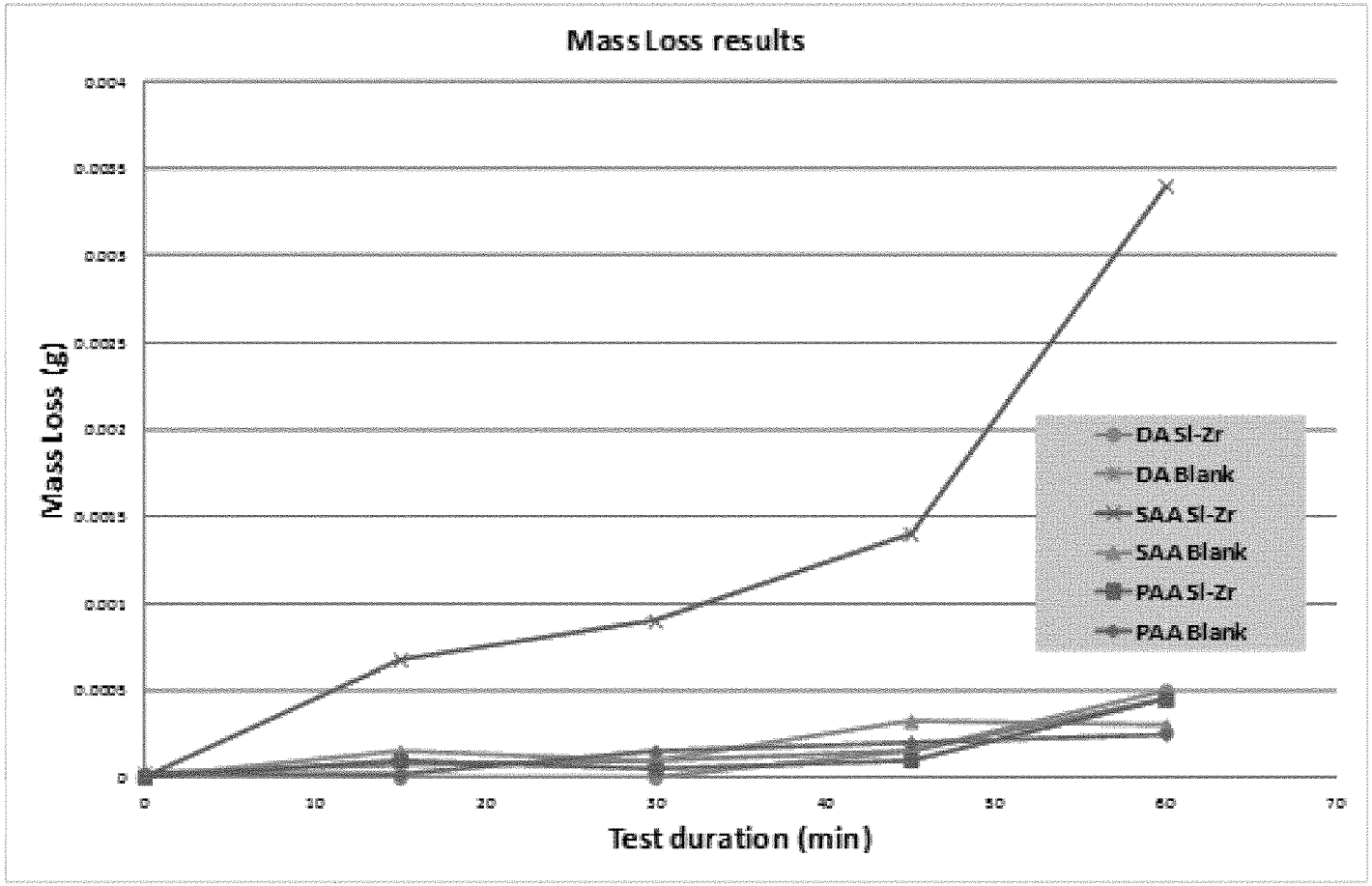
FIG. 5 is a graph showing rain erosion performance of anodised and sol-gel sealed systems on clad 2024-T3.
Figure 6:
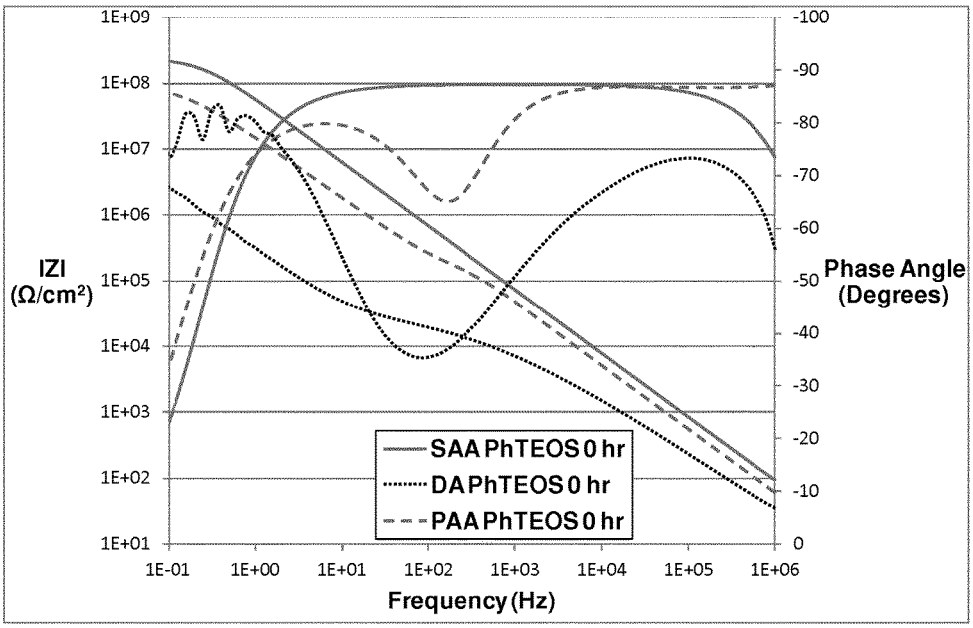
FIGS. 6(*a*) and 6(*b*) show 0 h impedance and phase plots for PhTEOSand Si—Zr sealed anodic layers on AA2024-T3.
Figure 6:
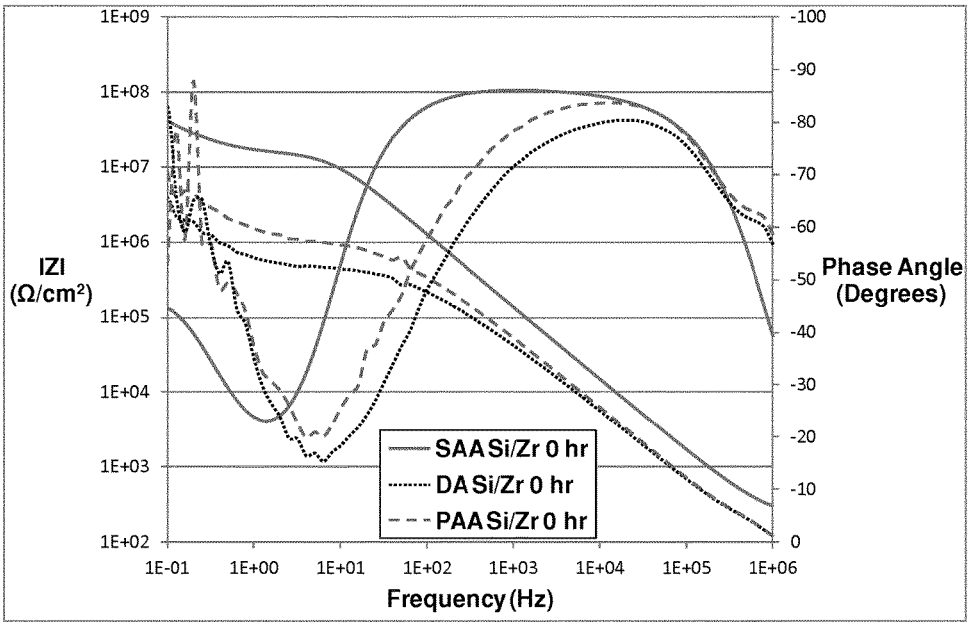

Whirling arm rain erosion evaluation of the Si—Zr sol-gel sealed clad 2024-T3 samples was conducted and the weight loss over the 60 min exposure was recorded as seen in FIG. 5. The weight loss for the sol-gel applied on the SAA is significantly greater than any other surface tested. From the EDX analysis FIG. 6 it is determined that the sol-gel forms a surface coating on the SAA surface with limited encapsulation in the porous anodic alumina. The rain erosion and weight loss of this system is of the sol-gel coating only which is mechanically inferior to the aluminium oxides produced from SAA, PAA and DA as well as the sol-gel/alumina composites produced from sol-gel encapsulation.

This indicates that the encapsulation of the sol-gel coatings in anodic alumina presents a significant improvement in rain erosion. The weight loss of the bare anodic layers or sol-gel encapsulated layers is minimal.

The electrochemical properties of the treated anodised aluminium panels can be used to estimate the potential long term performance in aggressive challenging environments. EIS is an AC technique used to estimate electrochemical interactions at the coating metal interface at a preset potential, usually the open circuit potential. The EIS analysis involved applying an AC voltage at the OCP, with sinusoidal amplitude of 10 mV, from a frequency of $10^6$ Hz down to $10^{-1}$ Hz across the sealed anodic layer. The films resistance to the AC signal, or impedance, varies according to the applied frequency and is graphically represented on a Bode frequency plot. The phase angle associated with the impedance gives valuable information on the film properties such as barrier performance and interfacial activity.

EIS analysis was conducted on the un-clad 2024-T3 as the electrochemical response is from the copper rich base metal which is more susceptible to corrosion than the clad material. The 0 hr impedance and phase plot for the PhTEOS sealed anodic layers can be seen in FIG. 5. The PAA and DA layers exhibit a characteristic two time constant response corresponding to a sealed porous layer and a barrier layer contribution. Conversely the SAA PhTEOS layer exhibits a single time constant phase angle response. PhTEOS sol-gel sealed SAA anodic layers have been previously reported and have produced a similar single time constant response REF REF. From the EDX analysis it is known that this sealer penetrates the porous network and the EIS response is as a result of the sol-gel/oxide composite layer. The Si—Zr sol-gel where pore penetration is absent on the SAA layer exhibits a two time constant response as seen in FIG. 5. These features correspond to the sol-gel coating and the barrier layer. The Si—Zr sealed PAA and DA layer exhibit a two time constant response similar to the PhTEOS sealed equivalents.

Figure 7A:
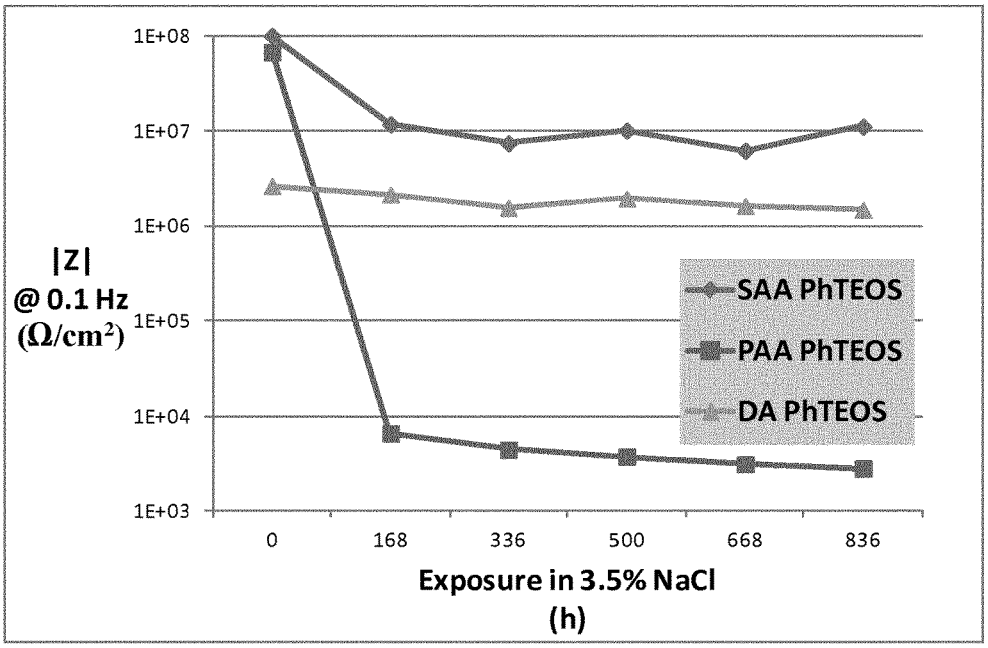
FIG. 7 shows the Time to First Detection of Corrosion during Neutral Sail Spray Testing.
Figure 7B:
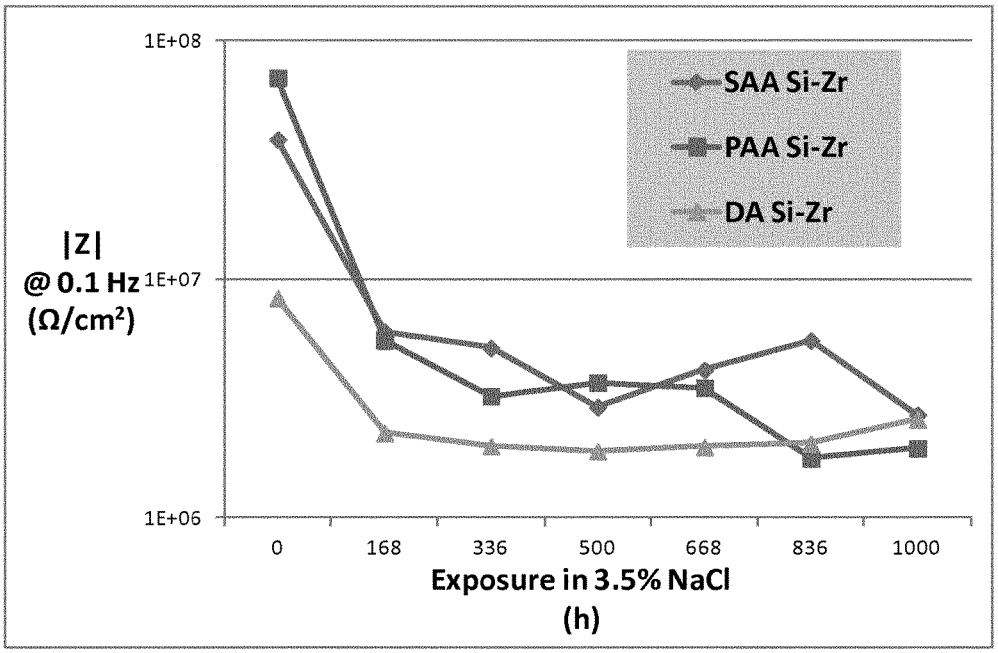
Figure 8:
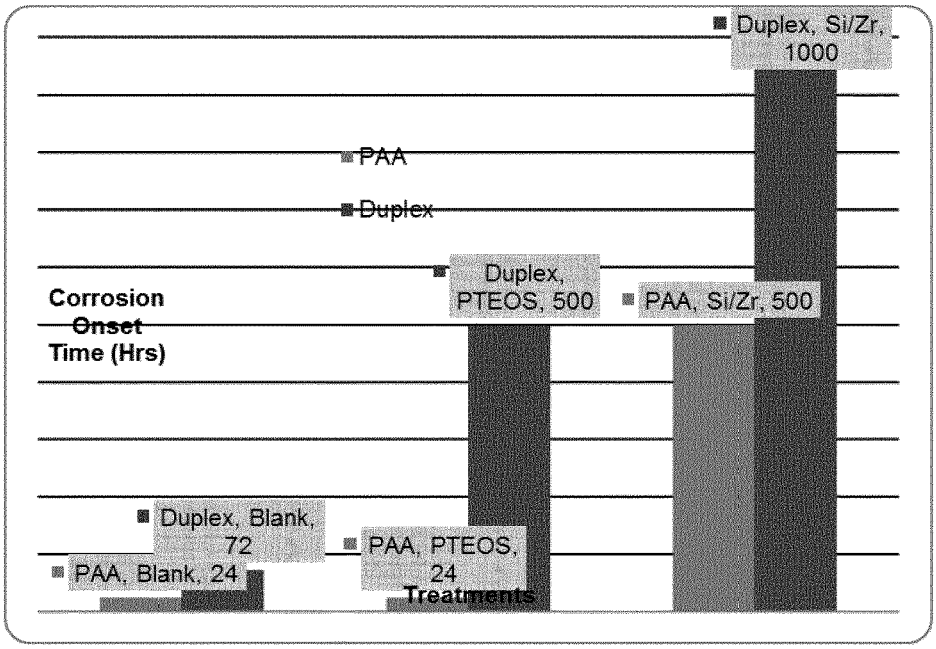
FIG. 8 shows photographs of Phosphoric acid and Duplex Anodising Sealed with Phenyltriethoxysilane based Sol-gel after NSS salt spray intervals
Figure 9:
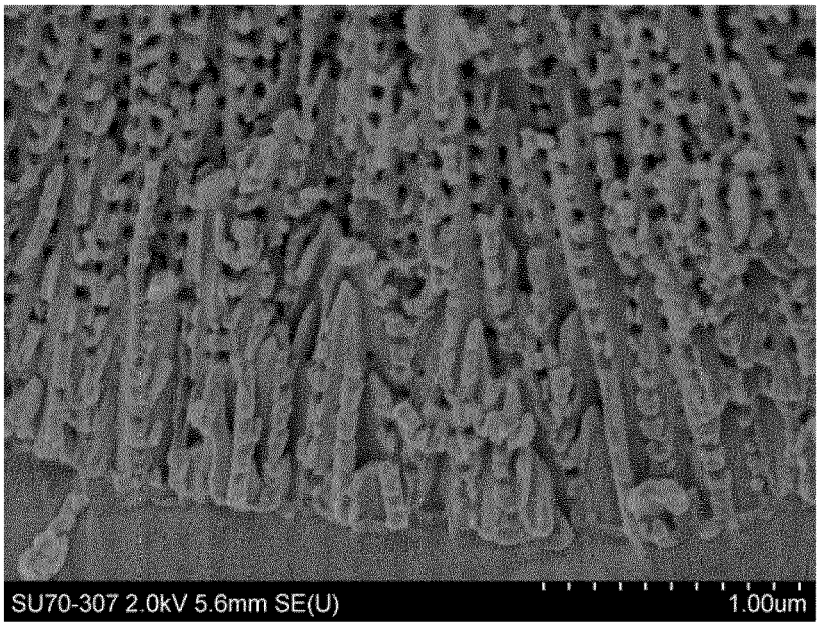
FIG. 9 is an electron microscope image showing an exploded view of the 3D network having lateral porosity (interporosity) structure of the first anodic layer (the PAA layer) of the duplex anodic layer formed on a clad Aluminium alloy (3003-H13)
Figure 10:
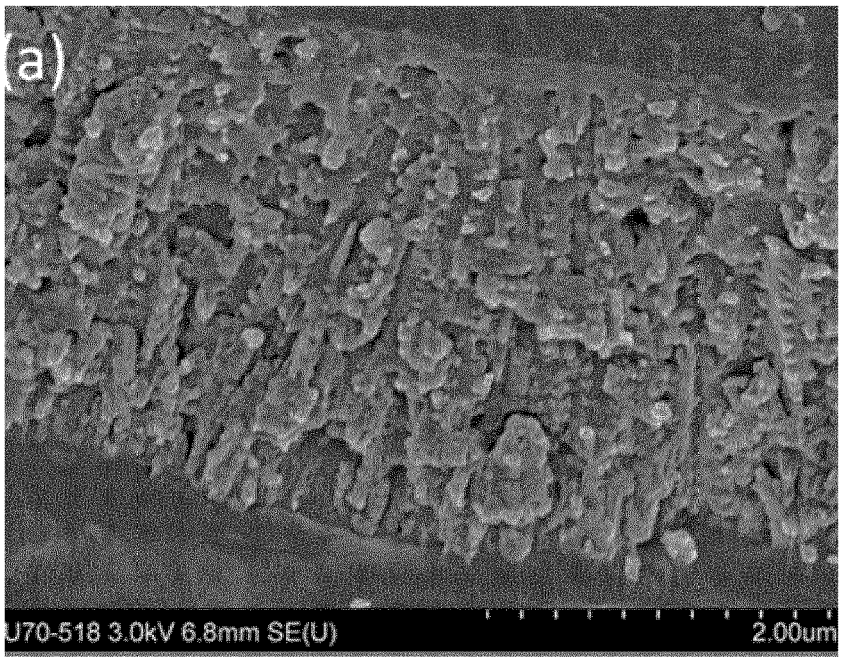
FIG. 10 is an electron microscope image showing an exploded view of the 3D network having lateral porosity (interporosity) structure of the first anodic layer (the PAA layer) of the duplex anodic layer formed on a clad Aluminium alloy (3003-H13) and with sol-gel encapsulated in the first anodic layer.

By plotting the impedance at 0.1 Hz over time the evolution of barrier properties can be determined. The protection properties of each sealer over time can be seen in FIG. 6. For the PhTEOS sealed anodic layers, FIG. 7(*a*), the SAA and DA layers appear stable up to 668 h while the impedance of the PAA layer drops rapidly at 168 h exposure. At this exposure time the PAA PhTEOS sealed layer exhibits extensive pitting and corrosion. The increased impedance of the SAA system compared to the DA is due to the longer anodising duration of the SAA system. The SAA and DA exhibit stable impedance up to 836 h.

In the case of the Si—Zr sol-gel sealed anodic layers all system experience a drop in impedance after 168 h however after this time the impedance stabilises. This initial drop is possibly due to uptake of electrolyte by the sol-gel coating. After this time the impedance stabilises.

Neutral salt spray exposure was also conducted on the anodised and sol-gel sealed samples. In unsealed form the SAA, PAA and DA surfaces offer little protection with corrosion occurring rapidly. The SAA and PAA layers exhibited pitting corrosion after 24 h exposure with the DA surface remaining clear of corrosion until 72 h exposure. Upon the onset of initial corrosion pitting increases rapidly for all of the unsealed anodised surfaces. Treating of the SAA and PAA surfaces with the PhTEOS sol-gel exhibits limited increase in protection. The presence of the sol-gel within the pores of the SAA layer appears to have a negative effect on corrosion prevention with a marginally higher level of pitting exhibited on the PhTEOS treated surface when compared to the unsealed SAA. This is possibly due to the effect on hydration due to the presence of the sol-gel within the aluminium oxide network. The sol-gel may retard the hydration of the surfaces as has been previously reported. In the case of the PhTEOS PAA layer there is a marginal reduction in pitting however the performance over the unsealed PAA is negligible. The PhTEOS sealed DA layer exhibited a marked increase in pitting prevention over the other anodising finishes.

TABLE 1

Neutral salt spray corrosion ratings of anodic layers on AA2024-T3

| Treatment | | First Cor | NSS Duration | | | | | | | |
|---|---|---|---|---|---|---|---|---|---|---|
| Anodising | Sol-gel | $TCorr_0$ | 24 h | 168 h | 500 h | 750 h | 1000 h | 1500 h | 2000 h | 3500 h |
| SAA | BLANK | 24 | 1 | 6 | 50 | 50 | — | — | — | — |
| PAA | BLANK | 24 | 200 | — | — | — | — | — | — | — |
| DA | BLANK | 72 | 0 | 12 | 200 | — | — | — | — | — |
| SAA | PhTEOS | 24 | 1 | 12 | 50 | 100 | — | — | — | — |
| PAA | PhTEOS | 24 | 50 | 200 | — | — | — | — | — | — |
| DA | PhTEOS | 500 | 0 | 0 | 1 | 12 | 12 | 25 | — | — |
| SAA | Si—Zr | 3500 | 0 | 0 | 0 | 0 | 0 | 0 | 0 | 1 |
| PAA | Si—Zr | 500 | 0 | 0 | 1 | 12 | 25 | 200 | — | — |
| DA | Si—Zr | 1000 | 0 | 0 | 0 | 0 | 1 | 6 | — | — |

The Si—Zr sol-gel presents enhanced pitting corrosion protection over the PhTEOS sol-gel sealed systems. The increased barrier properties as well as the inclusion of an active corrosion inhibitor results a significant level of protection on all anodising treatments. The SAA layer in particular exhibits remarkable corrosion resistance with no evidence of pitting at 3500 h. The absence of pore penetration of the Si—Zr sol ensures that the natural hydration properties of the SAA layer are retained. Furthermore the inclusion of an appropriate corrosion inhibitor may also have a positive effect on the integrity of the SAA layer. The tetrazine based inhibitor is known to bind to and chelate copper ions. The DA equivalent shows a higher degree of degradation, when compared to the SAA equivalent, possibly due to the decrease thickness of the SAA layer. The worst performing Si—Zr sealed layer is the PAA.

For many sol-gel coating additives there is a critical concentration after which the additive affects the film forming properties and integrity of the applied sol-gel film. Excess amounts of corrosion inhibitors have been shown to have a negative effect on film forming properties of sol-gel coatings. By utilising a duplex anodic oxide the active corrosion inhibitors can be incorporated in the SAA layer at a significantly higher concentration while the sol-gel can be encapsulated in the porous PAA network. DA allows addition of inhibitor into the SAA layer.

Further Examples

Example 2 (Combined Electropolishing and Anodising)

Aluminium alloy 6063 is exposed to an aqueous electrolyte containing 40% $H3PO_4$ at 70° C. The aluminium acts as an anode with a lead cathode. A current of approx 6 A/dm$^2$ is applied. The applied potential is approximately 80V. This procedure results in a combined action of surface polishing as well as growth of a phosphate rich anodic layer on the surface of the metal. The process is conducted for 20 mins to achieve a high level of surface brightening. At the end of the combined polishing and anodising cycle the current is halved and the potential is allowed to float to achieve a lower steady state value. This current reduction process is repeated until a steady state voltage of 10V is achieved. The part is then removed from the phosphoric acid bath and rinsed in de-ionised water. The part is then exposed to a room temperature electrolyte of 25% $H2SO_4$ and a current of 1.5 A/dm$^2$ is applied for 20 mins. This grows a protective anodic layer between the initial phosphate rich oxide and the brightened base metal.

Example 3 (Surface Conditioning Process)

Aluminium alloy 2024 is exposed to an aqueous electrolyte containing 10% $H_3PO_4$ at 40° C. The aluminium acts as an anode with a lead cathode. A potential of 30V is applied. The process is conducted for 10 mins. This procedure results in a combined action of growing a phosphate rich anodic layer while also conditioning the metal prior to a second anodisation. The process aides in the removal of intermetallics in the alloy that do not anodise at the same rate as the aluminium matrix. At the end of the combined conditioning and anodising cycle the current is halved and the potential is allowed to float to achieve a lower steady state value. This current reduction process is repeated until a steady state voltage of 10V is achieved. The part is then removed from the $H_3PO_4$ bath and rinsed in de-ionised water. The part is then exposed to a room temperature electrolyte of 25% $H_2SO_4$ and a current of 1.5 A/dm$^2$ is applied for 20 mins. This grows a protective anodic layer between the initial phosphate rich oxide and the conditioned base metal.

Example 4 (High Potential Process)

A high voltage process can also be utilised for the first anodising step. A aluminium alloy 3003 is exposed to a 4% $H_3PO_4$ electrolyte at room temperature. The aluminium acts as an anode with a lead cathode. A potential of 120V is applied to the aluminium anode to grow a phosphate rich anodic layer. At the end of the combined polishing and anodising cycle the current is halved and the potential is allowed to float to achieve a lower steady state value. This current reduction process is repeated until a steady state voltage of 10V is achieved. The part is then removed from the phodpsoric acid bath and rinsed in de-ionised water. The part is then exposed to a room temperature electrolyte of 25% $H_2SO_4$ and a current of 1.5 A/dm$^2$ is applied for 20 mins. This grows a protective anodic layer between the initial phosphate rich oxide and the base metal.

In summary, the method according to the present invention has the advantage that it can be utilised for adhesion and bonding applications while also retaining a significant level of corrosion resistance on aluminium alloys. The duplex anodic layer is particularly suitable for sol-gel sealing. Due to the low thickness of sol-gel coatings the PAA layer can be tailored to result in full encapsulation of the sol-gel coating within the anodic structure. Furthermore conventional sealing methods can be applied to the SAA base layer of the DA structure. This results in elevated corrosion resistance while also preventing the sol-gel material from migrating into the SAA pores. The natural hydration properties of SAA layer is therefore not affected by the presence of the sol-gel material while encapsulation in the PAA layer increases the mechanical properties of the sol-gel.

The words comprises/comprising when used in this specification are to specify the presence of stated features, integers, steps or components but does not preclude the presence or addition of one or more other features, integers, steps, components or groups thereof.

The invention claimed is:

1. A method for producing a multi-layer anodic coating on a metal which comprises the steps of:

(i) placing the metal in a first electrolytic solution and applying a current as a steady state current to form a first anodic layer having a barrier region;

(ii) reducing the applied current to cause a reduction in thickness of the barrier region; and (iii) placing the electrolytically modified metal in a second electrolytic solution and applying a current to form a second anodic layer, wherein the multi-layer anodic coating comprises the first anodic layer and the second anodic layer, and wherein the first anodic layer comprises pores having relatively large pore diameter size and the second anodic layer comprises pores having relatively small pore diameter size, and wherein step (i) comprises a first anodizing process having a final forming voltage and step (iii) comprises a second anodizing process having an initial forming voltage; wherein following step (ii), the final forming voltage of the first anodizing process is less than the initial forming voltage of the second anodizing process and wherein the final forming voltage after step (ii) is in the range of 2V to 10V.

2. The method according to claim 1 wherein the current in step (ii) is reduced by an amount of up to 50% from the steady state current in step (i).

3. The method according to claim 2, further comprising the step of repeating step (ii) sequentially for a period of time.

4. The method according to claim 1 wherein the multi-layer anodic coating comprises a duplex anodic layer.

5. The method according to claim 1 wherein the pores having relatively large pore diameter size have a diameter in the range of 50 to 150 nm.

6. The method according to claim 1 wherein the pores having relatively small pore diameter size have a diameter in the range of 10 to 25 nm.

7. The method according to claim 1, wherein the first electrolytic solution is selected from the group consisting of phosphoric acid, oxalic acid, sulphuric acid solution and mixtures thereof.

8. The method according to claim 1 wherein the second electrolytic solution is selected from the group consisting of sulphuric acid solution, oxalic acid solution, tartaric acid solution, boric acid solution and mixtures thereof.

9. The method according to claim 1 wherein the first electrolytic solution comprises from 1 to 20% phosphoric acid and the second electrolytic solution comprises from 1 to 30% sulphuric acid.

10. The method according to claim 1 wherein the first anodic layer comprises a phosphoric acid anodic layer comprising pores having a diameter in the range of 50 to 100 nm.

11. The method according to claim 1 wherein the second anodic layer comprises a sulphuric acid anodic layer comprises pores having a diameter in the range of 10 to 25 nm.

12. The method according to claim 11, further comprising the step of applying a sealing or corrosion inhibiting treatment to said sulphuric acid anodic layer.

13. The method according to claim 12 wherein said corrosion inhibiting treatment is selected from the group consisting of nitrogen heterocycles, triazoles, triazines and tetrazines.

14. The method according to claim 12 wherein the sealing treatment includes hydrothermal, nickel acetate, nickel fluoride, sodium silicate or other conventional sealing treatments.

15. The method according to claim 11 wherein the first and second anodizing processes can be carried out using any electrochemical process that forms the appropriate porous oxide layer on the metal.

16. The method according to claim 15 wherein the formation of the appropriate porous oxide layer is optionally conducted simultaneously with an additional surface electrochemical process.

17. The method according to claim 16 wherein the additional surface electrochemical process comprises an electrobrightening process.

18. The method according to claim 16 wherein the additional surface electrochemical process comprises the tailoring of the first anodizing process to form the appropriate porous oxide layer while simultaneously consuming the native oxide present on the metal surface; wherein the metal comprises aluminium.

19. The method according to claim 18 wherein the first anodizing process is optionally tailored to remove intermetallics from the metal surface that anodize at a slower rate than the aluminium metal.

20. The method according to claim 19 wherein the first anodizing process is used to prepare the aluminium surface and remove any said intermetallics; and the second anodizing process is then conducted with the appropriate porous oxide layer thereby exhibiting optimum protection properties.

21. The method according to claim 20 wherein the multilayer anodic coating comprises a duplex anodic structure wherein the first anodic layer comprises a phosphoric acid anodic layer comprising pores having a diameter in the range of 50 to 100 nm and wherein the second anodic layer comprises a sulphuric acid anodic layer comprising pores having a diameter in the range of 10 to 25 nm.

22. The method according to claim 1 wherein step (i) is conducted at 10 to 200V volts for 1 to 240 minutes.

23. The method according to claim 22, wherein step (i) is conducted at between 30 to 50V.

24. The method according to claim 23, wherein step (i) is conducted at about 40V.

25. The method according to claim 1, further comprising the step of sealing an interface between the first anodic layer and the second anodic layer.

26. The method according to claim 25 wherein the first anodic layer comprises a phosphoric acid layer and the second anodic layer comprises a sulphuric acid layer.

27. The method according to claim 26, further comprising the step of applying a coating or adhesive to the phosphoric acid layer.

28. The method according to claim 27, wherein the coating comprises a sol-gel.

29. The method according to claim 28 wherein the sol-gel is selected from the group consisting of an inorganic, organic or hybrid precursors.

30. The method according to claim 1 wherein the first anodic layer comprises a structure of pores having openings formed at intervals along the longitudinal axis of the pore such that adjacent pores are in fluid connection thereby allowing a material to flow laterally between one columnar pore and a neighbouring columnar pore such that lateral porosity is achieved thereby enabling full encapsulation of a material throughout the first anodic layer.

31. The method according to claim 30 wherein the first anodic layer comprises a phosphoric acid layer.

32. The method according to claim 1 wherein the first and second electrolytic solutions are maintained at a temperature in the range of between 0° C. to 90° C.

* * * * *